US007481079B1

(12) United States Patent
Waldrop et al.

(10) Patent No.: US 7,481,079 B1
(45) Date of Patent: Jan. 27, 2009

(54) CIRCULAR KNIT FABRIC AND METHOD

(75) Inventors: Anthony Waldrop, Easley, SC (US); Kimberley Kerchmar, Spartanburg, SC (US); Derek Sharp, Greer, SC (US); Durwin Glenn Dawson, Anderson, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 11/906,734

(22) Filed: Oct. 3, 2007

(51) Int. Cl.
*D04B 1/22* (2006.01)

(52) U.S. Cl. ..... 66/170; 66/194

(58) Field of Classification Search ..... 66/8, 66/9 R, 9 A, 169 R, 170, 190, 191, 194; 442/304, 442/312
See application file for complete search history.

(56) References Cited

U.S. PATENT DOCUMENTS

| | | | | | |
|---|---|---|---|---|---|
| 2,266,678 | A | * | 12/1941 | Krasnov et al. | 66/170 |
| 3,937,041 | A | * | 2/1976 | Balcombe | 66/197 |
| 3,991,582 | A | | 11/1976 | Waldrop et al. | 61/48 |
| 4,024,723 | A | | 5/1977 | Mayfield et al. | 61/98 |
| 4,047,391 | A | | 9/1977 | Mayfield et al. | 61/94 |
| 4,068,497 | A | | 1/1978 | Haynie | 66/50 |
| 4,069,688 | A | | 1/1978 | Sanders | 66/1 R |
| 4,537,048 | A | | 8/1985 | Gutschmit et al. | 66/93 |
| 4,612,784 | A | * | 9/1986 | Plath | 66/9 R |
| 5,027,618 | A | * | 7/1991 | Robinson et al. | 66/202 |
| 5,186,025 | A | * | 2/1993 | Neher | 66/9 R |
| 5,209,084 | A | * | 5/1993 | Robinson et al. | 66/196 |
| 5,215,807 | A | * | 6/1993 | Day et al. | 428/193 |
| 5,457,968 | A | * | 10/1995 | McClintock et al. | 66/202 |
| 5,533,789 | A | | 7/1996 | McLarty, III et al. | 297/452.64 |
| 5,596,888 | A | | 1/1997 | McLarty, III et al. | 66/195 |
| 5,632,526 | A | | 5/1997 | McLarty, III et al. | 297/452.64 |
| 5,651,847 | A | | 7/1997 | Loeffler | 156/71 |
| 5,807,794 | A | | 9/1998 | Knox et al. | 442/306 |
| 5,856,249 | A | | 1/1999 | Waldrop et al. | 442/184 |
| 5,890,381 | A | * | 4/1999 | Leeke et al. | 66/170 |
| 5,902,753 | A | | 5/1999 | DeMott et al. | 442/79 |
| 5,983,470 | A | | 11/1999 | Goineau | 28/281 |
| 6,048,581 | A | | 4/2000 | Waldrop, III | 427/412 |
| 6,128,930 | A | * | 10/2000 | Schmidt | 66/92 |

(Continued)

OTHER PUBLICATIONS

Haworth Office Furniture Catalog—Zody Guest Chair.

(Continued)

*Primary Examiner*—Danny Worrell
(74) *Attorney, Agent, or Firm*—John E. Vick, Jr.; Cheryl J. Brickey

(57) ABSTRACT

A circular knitted fabric and a method for making such a fabric is disclosed. The fabric employs a multifilament elastomeric yarn as a ground yarn and a polyester yarn as a pile yarn. The fabric is comprised of a plurality of knitted regions arranged in a pre-defined ornamental pattern on the fabric. The fabric has at least a first non-pile region and a second region having a pile of a first height. Also, a third region provides a pile of a second height. The fabric is visibly translucent through at least the first region of the fabric, so that an object positioned on a first side of the fabric is visible from the second side of the fabric when the object is viewed through the non-pile first region of the fabric.

20 Claims, 6 Drawing Sheets

U.S. PATENT DOCUMENTS

| | | | | |
|---|---|---|---|---|
| 6,227,010 | B1 * | 5/2001 | Roell | 66/170 |
| 6,337,294 | B1 | 1/2002 | Waldrop, III | 442/71 |
| 6,435,221 | B1 | 8/2002 | Waldrop et al. | 139/422 |
| 6,632,756 | B1 | 10/2003 | Waldrop et al. | 442/314 |
| 6,668,435 | B2 | 12/2003 | Wood et al. | 28/162 |
| 6,705,129 | B2 | 3/2004 | Pot d'Or | 66/93 |
| 6,832,419 | B1 | 12/2004 | Williamson et al. | 28/159 |
| 7,086,423 | B2 | 8/2006 | Keller et al. | 139/21 |
| 7,131,158 | B2 | 11/2006 | Brown et al. | 8/149 |

OTHER PUBLICATIONS

Herman Miller—Aeron® Chairs.
Radici Spandex Products—S-45 Product SP.
Radici Spandex Products—S-85 Product SP.

* cited by examiner

CIRCULAR KNIT FABRIC AND METHOD

BACKGROUND OF THE INVENTION

Modern designs for office furniture often require specially designed fabrics. Office task chairs are known in which the seating material that supports the weight of the chair occupant is comprised of an elastomeric monofilament in a woven fabric. One popular chair of this type of the Aeron® chair sold by Herman Miller, Inc. of Zeeland, Mich., USA. This brand of office chair employs elastomeric monofilament yarn combined with solution dyed textured polyester in a woven open mesh design.

It has been found that the use of monofilament in furniture seating sometimes provides excess friction upon the clothing of a person sitting in the chair. That is, monofilament-containing fabrics are rugged and durable, but unfortunately they sometimes accelerate the degradation and wear upon clothing that contacts the monofilament-containing fabric. Excessive wear upon the user's clothing is considered undesirable.

A recent design trend with regard to office seating is that consumers are believed to be attracted to chairs that will easily articulate to multiple positions, affording greater mobility while seated. Furthermore, back and lumbar support frame structures are sometimes highly visible in modern office and task chairs. Consumers like to see the support structures, and a chair that provides such structures in a highly visible way is sometimes desirable. Thus, a recent design trend is to provide mechanical support features of the chair in a highly visible manner.

One high performance task chair made by Haworth, Inc. of Holland Mich. is the Zody® office chair. This chair features an occupant support surface that comprises a flat woven fabric that is made using a leno weave construction. One example of leno weave construction is shown in U.S. Pat. No. 6,435,221 to Waldrop et al.

Circular knitted fabrics are used in automotive upholstery. One property of knitted fabrics is that they tend to stretch significantly as compared to woven fabrics. Most unsupported automotive knits are not capable of making a full "recovery" after displacement. That is, most automotive knits are not capable of returning reliably to their original configuration after undergoing significant and numerous stretching events. This prevents the use of such knits in many applications.

Knit fabrics have proven to be desirable in other applications, such as clothing, in which the fabric is not subject to significant loading stress. But, to make a knitted fabric suitable for automobile seating applications, such a fabric usually must be laminated to a scrim or backing material for support. Then, this composite laminated structure may be adhesively bonded to a foam bun or the like for installation into an automotive seat. Such applications of knitted fabrics use scrims and/or backing materials to keep the knitted fabric from stretching too far and becoming wrinkled or unsightly on the seating surface, after years of use by an occupant. Without such backing support materials, typical knitted automotive fabrics would not function properly for their intended purpose.

DETAILED DESCRIPTION OF THE INVENTION

Figure 1:
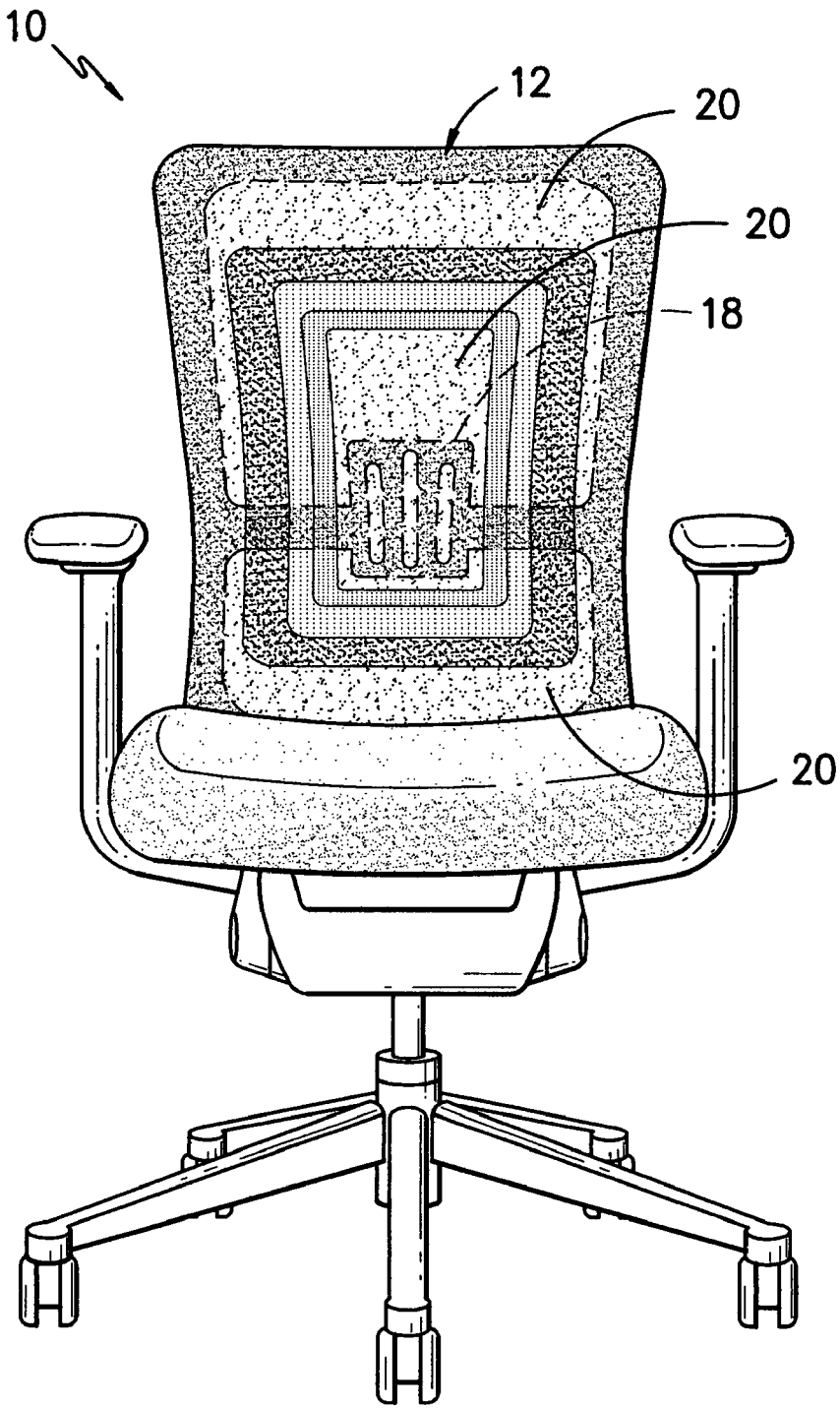
FIG. 1 shows an office task chair configuration using the inventive fabric of the invention.

The following examples further illustrate the subject matter described above but, of course, should not be construed as in any way limiting the scope thereof. The present invention provides a textile structure suitable for use as a support and aesthetic material for applications such as office chairs, school chairs, wheel chairs, automotive seats, airline seats, train seats, outdoor furniture and beds, sofa seating, and other applications.

The fabric provides a high degree of comfort and performance in such environments. At the same time, the fabric may be constructed so as to exhibit substantial resistance to repeated displacements, and therefore exhibits good stretch and importantly, also exhibits good recovery from stretch. Furthermore, at least a portion (region) of the circular knit fabric of the present invention is translucent, so that objects on one side of the fabric may be viewed (at least a shadow is visible) from the opposite side of the fabric, when viewing through the translucent portions of the fabric. In one embodiment of the invention, a chair design facilitates the human body to seamlessly interact with a fabric "skin" and skeletal structure of a seat framework. Accordingly, the present invention represents a useful advancement over the state of the art, with an aesthetic design appeal to consumers.

The fabric of the invention is a load-bearing fabric, as compared to conventional circular knit fabrics. That is, the fabric is capable of sustaining highly repetitive deflections with good recovery, and while retaining its shape. The fabric is a "support" fabric. For purposes herein, "support" fabric shall be defined as a fabric that is capable of bearing a load that is equivalent to all or a portion of one or more persons' body weight without mechanical supporting materials on the surface and/or underside of the fabric. That is, a support fabric for purposes herein does not require conventional foam backings, mechanical spring or foam systems, and the like that are commonly used to support circular knit fabrics for seating applications. The support fabric of this invention does not require such supporting structure, and may support substantial weight, with substantial repetitions, without losing shape and while retaining good recovery.

A circular knit pile fabric and method for making the fabric is provided in the invention. The fabric is comprised of ground yarns and pile yarns, wherein the ground yarns of the knit are multifilament and also "elastomeric", as that term is defined herein. The fabric is typically defined in a two-dimensional plane, the plane having a first side and an opposite second side. The fabric is capable of stretch in essentially all directions along the plane. Furthermore, in most applications, the fabric is able to stretch and then provide almost total recovery for a large number of repetitions. Thus, the fabric is durable, and is capable of acting as a support fabric. Further, after being stretched it will recover to its original position for many, many repetitions. In most applications, the fabric is comprised of a plurality of knitted regions arranged in a predefined pattern on the fabric, said fabric having at least a non-pile first region, a second region having a pile of a first height. Optionally, a third region having a pile of a second height also is provided, wherein the second height is greater than the first height. The fabric is visibly translucent through at least the first region of the fabric. As an example, an object positioned on a first side of the fabric (such as lumbar support structure 18) is visible from the second side of the fabric when the object is being viewed through the first region of the fabric. In many applications, the pile yarns are comprised of textured polyester. Further, the fabric in some embodiments may even comprise a fourth region with pile yarns of a third height, wherein the third height is greater than the second height. In one aspect of the invention, an object positioned on a first side of the fabric is visible from the second side of the fabric when the object is viewed through the non-pile translucent first region of the fabric. The non-pile translucent first region of the fabric may provide, in some applications, a light transmittance value of at least about 5% Transmittance in the light range of 400-700 nm. In other embodiments, the fabric may provide a fluorochemical-containing repellent finish and/or an antimicrobial agent upon the pile of the fabric. In some applications, the fabric may be constructed with a non-pile translucent first region having a % Transmittance of between about 5 and about 13. The non-pile translucent first region of the fabric comprises, in some particular embodiments, a % Transmittance of at least about 7 at a wavelength of 550 nm.

For purposes of this disclosure, it is recognized that not all yarns in a given region are the same height, and it is common for a region to have a pattern within the region in which individual yarns are pulled at variable heights. But, for purposes herein, "height" refers generally to the average height of yarns in the given region, and this term "height" does not in any way imply that all yarns in a region are of the same height, as they usually are not.

In one aspect of the invention, a method of making a support fabric is provided. The method may comprise providing an elastomeric yarn as a ground yarn, providing textured polyester yarn as a pile yarn, and then circular knitting the elastomeric yarn with the polyester yarn to form a support fabric defined in a two-dimensional plane. The plane includes a first side and an opposite second side, the support fabric being capable of stretch in essentially all directions along the plane. Further, the support fabric is comprised of a plurality of knitted regions arranged in a pre-defined pattern on the fabric, said support fabric having at least a first non-pile region, and a second region having a pile of a first height and a third region having a pile of a second height, wherein said second height is greater than the first height. The support fabric also is visibly translucent through at least the first region of the support fabric, whereby an object positioned on a first side of the support fabric is visible from the second side of the fabric when the object is viewed through the first region of the fabric. The support fabric, in some particular embodiments, additionally comprises a third region having a pile of a second height, wherein said second height is greater than the first height. In at least one aspect of the invention, an object positioned on a first side of the support fabric is visible from the second side of the fabric when the object is viewed through the non-pile translucent first region of the fabric. Further, the non-pile translucent region of the fabric may provide a light transmittance value of at least about 5% Transmittance within the light wavelength range of 400-700 nm. The non-pile translucent first region of the fabric comprises, in one embodiment, a % Transmittance in the range of about 5 to about 13. In yet another embodiment, the non-pile translucent first region of the fabric comprises a % Transmittance of at least about 7 at 550 nm. Additional steps of heat setting and drying the fabric are typically employed as well. An optional fluorochemical treatment or antimicrobial compound treatment, or both, may applied as further described herein.

When the fabric is applied to office furniture, such as a task chair, it is possible to "see through" the first region so that mechanical parts of the chair may be seen by the user. This creates an interesting and pleasing design style that would not be possible if the fabric were simply opaque. Many users enjoy the "look" of a skin over skeletal design, in which the fabric is the see through "skin", and the lumbar and back support portions of the chair comprise the "skeleton". Many different patterns may be used in which the pile height of the fabric varies in the pattern to achieve a certain visual effect. In the case of a task chair, first regions (which are translucent, and allow a person to see through to object on the opposite side) may be concentrated upon the certain portions of the chair that reveal the mechanical support portion of the chair. Furthermore, first region(s) may be provided in a decorative design, and they may have distinct boundaries. In other instances, these first regions may provide a gradient effect in which the degree of translucency of the first region varies in a circular or rectangular pattern. Such a pattern may correspond with the back or seat geometry of the chair.

In one application of the invention, a circular knit elastomeric fabric combines the aesthetics of a traditional knit pile fabric with an elastomeric multifilament ground yarn to create a fabric that may be patterned and engineered to function as the skin of an "active" seating system. An "active" seating system is a system that allows the human body seamlessly to interact with the fabric skin and the skeletal structure of the seat framework. The pattern may be modified or customized to adapt to the chair design under review. The degree of translucence in the first region can be altered to allow a controlled amount of light to pass through certain areas of the fabric. The force required to stretch or deflect this fabric can be designed into the fabric by combining knit pattern, elastomeric yarn type and size, and finishing technique. In some applications of the invention, the fabric further is treated with a fluorochemical finish that is stain resistant and repels water and/or oil. Further, it may be useful to apply an antimicrobial to the fabric. In some applications, the antimicrobial is applied in a finishing solution that may be padded upon the finished fabric.

The circular knit fabric in the invention comprised of ground yarns and pile yarns that are interconnected to the ground yarns. The topology of knitted fabrics is relatively complex. Unlike woven fabrics, where strands usually run horizontally and vertically, yarn that has been knitted follows a relatively loopy path along its row, in which the loops of one row have all been pulled through the loops of the row below it. Because there is no single straight line of yarn in the pattern, a knitted piece can usually stretch in essentially all directions. This elasticity is typically unavailable in woven fabrics, which only stretch along the bias. Thus, there are significant advantages to the use of a circular knit fabric, but only if the fabric is strong and durable so that it is capable of acting as a structural member (in the case of a chair seat or chair back).

Knit fabrics are provided with yarn loops projecting on one or both sides from the base fabric. When the loops projecting from the base fabric are left as closed loops a so-called "pile" surface is created. It is likewise possible to cut of the turns of the loops so that separate yarns are left that project from the base fabric. In such a case, a pile fabric or velour is obtained. This fabric is soft to the touch, and is not abrasive. Such fabrics do not significantly abrade the clothing of users who sit or rub against them. Thus, one advantage of pile or velour over monofilament-containing seating fabrics is that the problem of abrasion of a user's clothing (i.e. the seat of his or her pants) is essentially avoided.

Circular knitting machines typically comprise the following elements: (a) a row of needles in circular arrangement for forming the stitches and loops, whose rising and lowering movement is controlled by a lifting cam or needle lock along a needle cam; (b) a holding-down and knock-over sinker (hereinafter briefly referred to as down sinker) as well as a piling sinker, with the down sinker and the piling sinker being disposed in parallel with each other between two respective needles and being able to carry out a reciprocating movement horizontal relative to the needles, which movement is controlled by a sinker lock along a first sinker cam for the holding-down and knock-over sinker and another sinker cam for the piling sinker; (c) control elements for needle selection in correspondence with the pattern, with the selection of a needle resulting in the fact that the needle follows the needle cam present at its instantaneous location whilst a non-selected needle remains in a home position (circular movement position); (d) yarn guiding means for feeding a base yarn as well as at least two loop or pile yarns for producing the pile loops. Persons of skill in the art of knitting are familiar with the operation of a circular knitting machine.

It is possible in such a circular knitting machine to predetermine for a particular stitch whether a pile loop is to be formed or not with the first and/or the second pile yarn for this stitch. The production of a pile loop takes place only when the sinker associated with the particular stitch is selected by the control elements when it passes along the respective stitch at the respective loop yarn. The use of different yarns for the loop yarns permits the production of pile loops of different colors or of different yarn qualities, depending upon the application. The height of the pile loops projecting from the base fabric is controlled by means of the piling sinker in the circular knitting machine, above whose upper edge the loop yarn is retained while the needle draws down a loop out of the yarn. The design is made by electronically selecting or not selecting each individual sinker to form pile height variations. Further details of the structure and of the mode of operation of circular knitting machines are disclosed in U.S. Pat. Nos. 6,705,129; 6,668,435; 4,069,688; 4,068,497 as will be appreciated by a person of skill in the art, and as incorporated by reference herein.

Pile fabric may be developed by taking advantage of the height differential that may be provided on the yarn loops. A designer typically will produce a three color design, although more or less is possible. Each individual design is given a specific identification number. For example design "CM001234". This is represented by pixels on a computer generated graph paper style format. Blue represents a high pile loop. Red represents a low pile loop and green represents a no pile loop. The designer will save this design as a PCX file and will later be translated into a machine parameter. This parameter incorporates the design and the machine attributes. Machine type, number of needles, feeds and color assignment. The parameter is stored on a floppy disc and loaded into the knit machine computer. This computer translates the information into a machine language. The sinkers on the circular knitting machine are programmed to reproduce the design submitted. A circular fabric tube is produced with a pile stitches and a ground stitches. A ground stitch is knitted on every needle in the machine and a pile loop for every sinker in the machine at a height dictated by the design. When the design size is smaller than the total number of needles in the machine the design will repeat in the width. The pattern will also repeat in the length as dictated by the parameter. Each design knitted is allocated a style number to give the company the ability to trace the design. This number usually is written on the fabric during processing. Upon completion of the fabric manufacture, a sample is cut and put into the a fabric library.

In one embodiment of the invention, the ground yarns employed are Riteflex® or Hytrel® multifilament copolyester yarn. Using such yarns may provide advantageous stretch and recovery in essentially all directions in the fabric. In another embodiment of the invention, the elastomeric yarn of the ground can be a bicomponent elastomeric yarn, such as a core/sheath yarn.

Elastomeric yarns, as used herein, means a nontextured yarn that can be stretched at room temperature to at least about twenty-five percent (25%) over its original length and which after removal of the tensile force will immediately and forcibly return and restore itself to within three percent (3%) of its original length. To determine if a yarn is elastomeric, ASTM Standard Test Method for Permanent Deformation of Elastomeric Yarns (D 3106-95a), incorporated by reference herein, can be used. However, the exception is that the specimen for purposes of the test is stretched to a length of 25% over the original length of the specimen for all stretching time periods, and the elongation after stretch is determined after the longer relaxation time period.

Referring now to FIG. 1, a first embodiment of the invention having three identifiable regions on the fabric 12 is shown. A task chair 10 is shown having circular knit pile fabric 12. The fabric 12 is stretched tightly upon the chair, and is substantially free of supporting structures or composites, such as scrims, backings and the like that are commonly associated with knit fabric seating applications. The chair provides lumbar support structure 18 which is visible through a non-pile first region 20 of the fabric 12.

Figure 2:
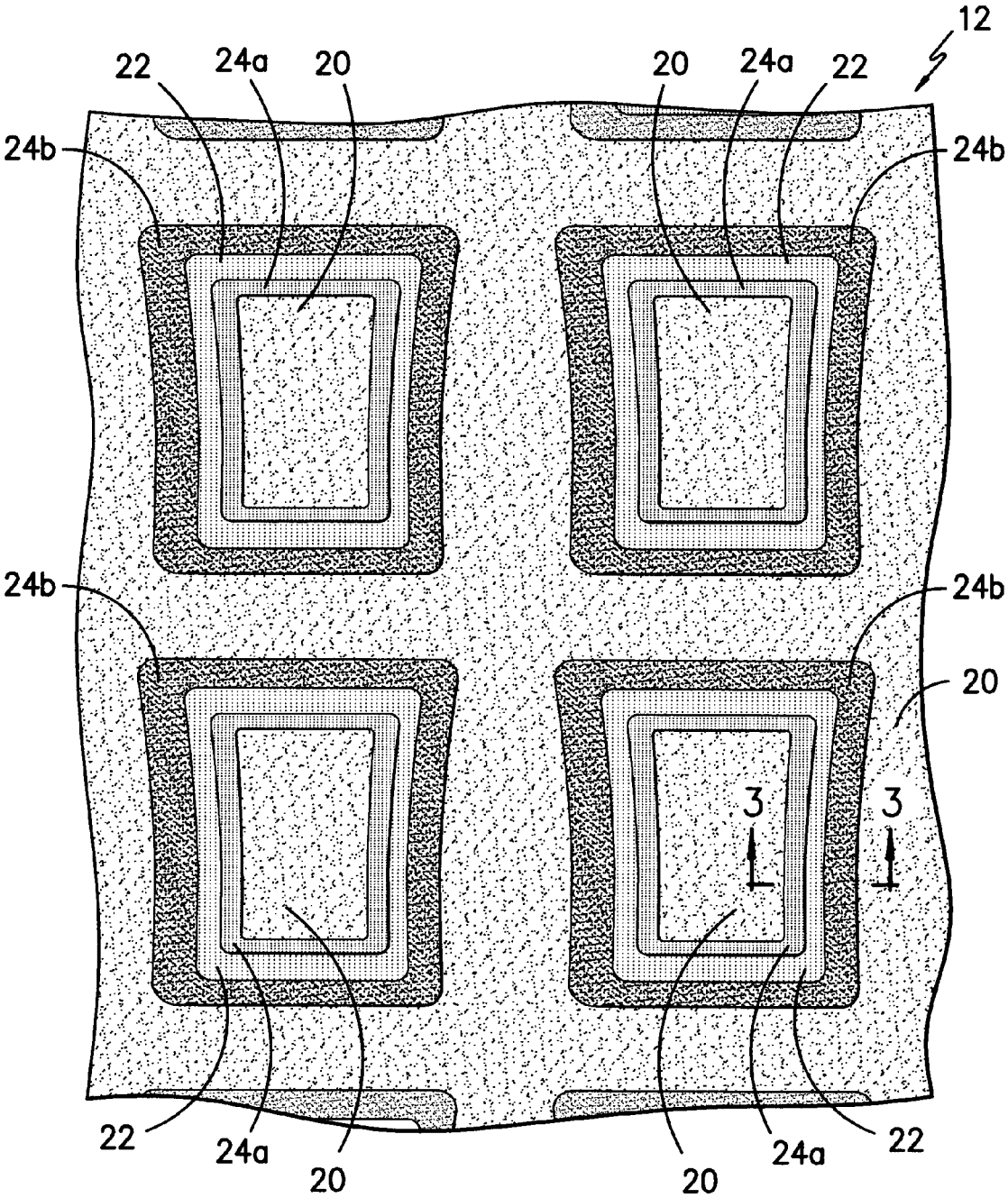
FIG. 2 shows a bolt of manufactured circular knit pile fabric having multiple pile height regions in the fabric, with translucent non-pile first regions that reveal mechanical aspects of the chair.

FIG. 2 shows a bolt of circular knit pile fabric 12 from which portions are cut for application to chair 10 in this first embodiment. The fabric 12 in this particular example provides a design that employs multiple pile height regions, which give a favorable Jacquard design. A non-pile first region 20 is shown, and is adjacent to a third region 24*b*. Directly adjacent the third region 24*b* is a second region 22. The second region 22 is adjacent another third region 24*a*. In this embodiment, the pile height of the second region 22 is less than the pile height of the third regions 24*a* and 24*b* (which also can be seen in connection with the discussion of FIG. 3 below). Further, the non-pile first region 20 is translucent, so that when the fabric is held up the light, one can see images and shadows of objects (such as lumbar support structure 18) behind the fabric 12.

Figure 3:
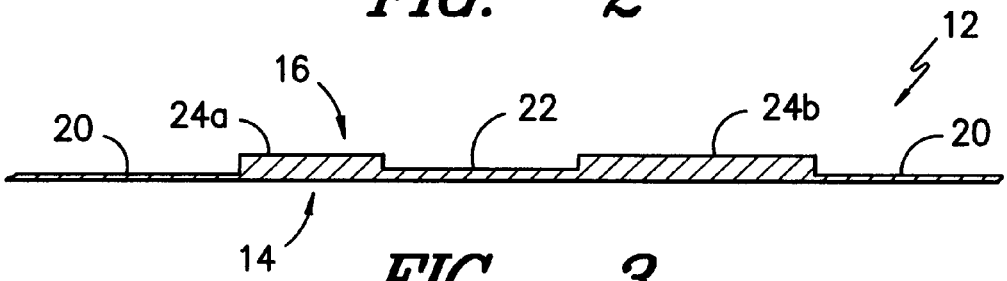
FIG. 3 is a partial cross-section of the fabric taken along lines 3-3 of FIG. 2, revealing the pile height regions in one portion of the fabric design.

FIG. 3 is a partial cross-section along lines 3-3 of FIG. 2. In this partial cross section, the relative pile heights of the various regions may be seen. Fabric 12 is seen with a first side 14 and a second side 16 that is opposite to the first side. A non-pile first region (which is translucent) may be seen adjacent one of the third regions 24*b*. A second region 22 is shown next, adjacent a third region 24*a*. The relative pile heights are shown for illustrative purposes only, and are not shown to scale. In other embodiments, the fabric could include a fourth region or fifth region (not shown) that provide additional and variable pile heights that provide pleasing aesthetic effects.

As indicated, there is no requirement that this fabric employ conventional scrims, backing materials, or other supporting structures upon the fabric. The circular knit of this invention surprisingly and unexpectedly is capable of supporting itself and the weight of chair occupants without such structures. Further, the fabric 12 is capable of being stretched and bonded (in a stretched condition) to the chair frame during construction of the chair by a variety of methods (not shown). The fabric 12 is capable of literally thousands of repetitive displacements with good recovery, and the fabric typically is free from substantial amounts of sag.

In the practice of the invention, it may be useful to first manufacture a greige fabric. Then, the greige fabric is typically slit, and then heatset. Then, the fabric may be dyed to the appropriate color shade, followed by drying. The fabric may be finished by application of any conventional finish, including for example a fluorochemical chemical treatment. Such a treatment provides repel properties (for liquids, food and the like that may be spilled upon the chair 10). Also, antimicrobial agents may be provided for odor control to reduce the amount of microbes that live or breed on the chair.

Figure 4:
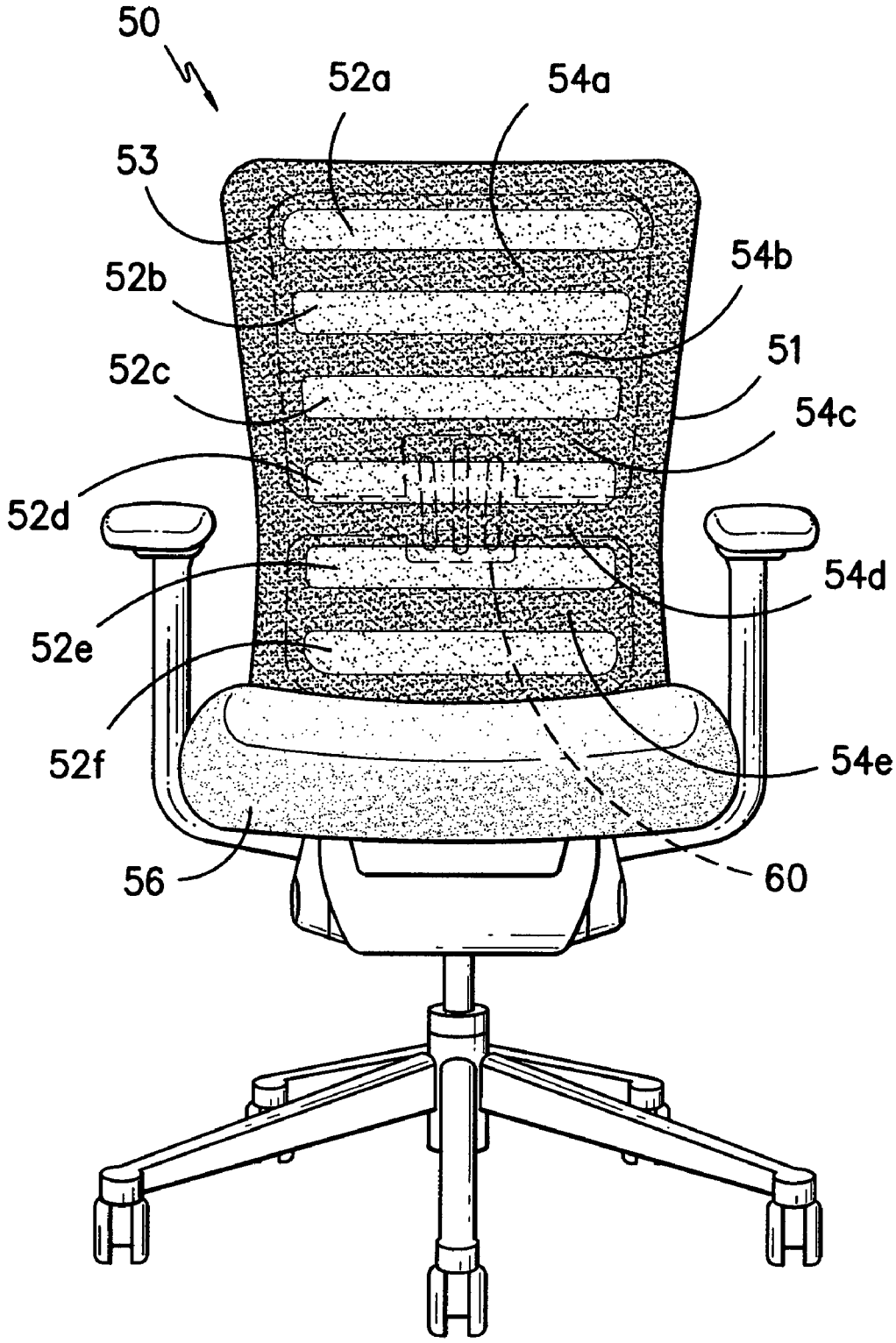
FIG. 4 is a second embodiment of the invention having only one pile height.
Figure 5:
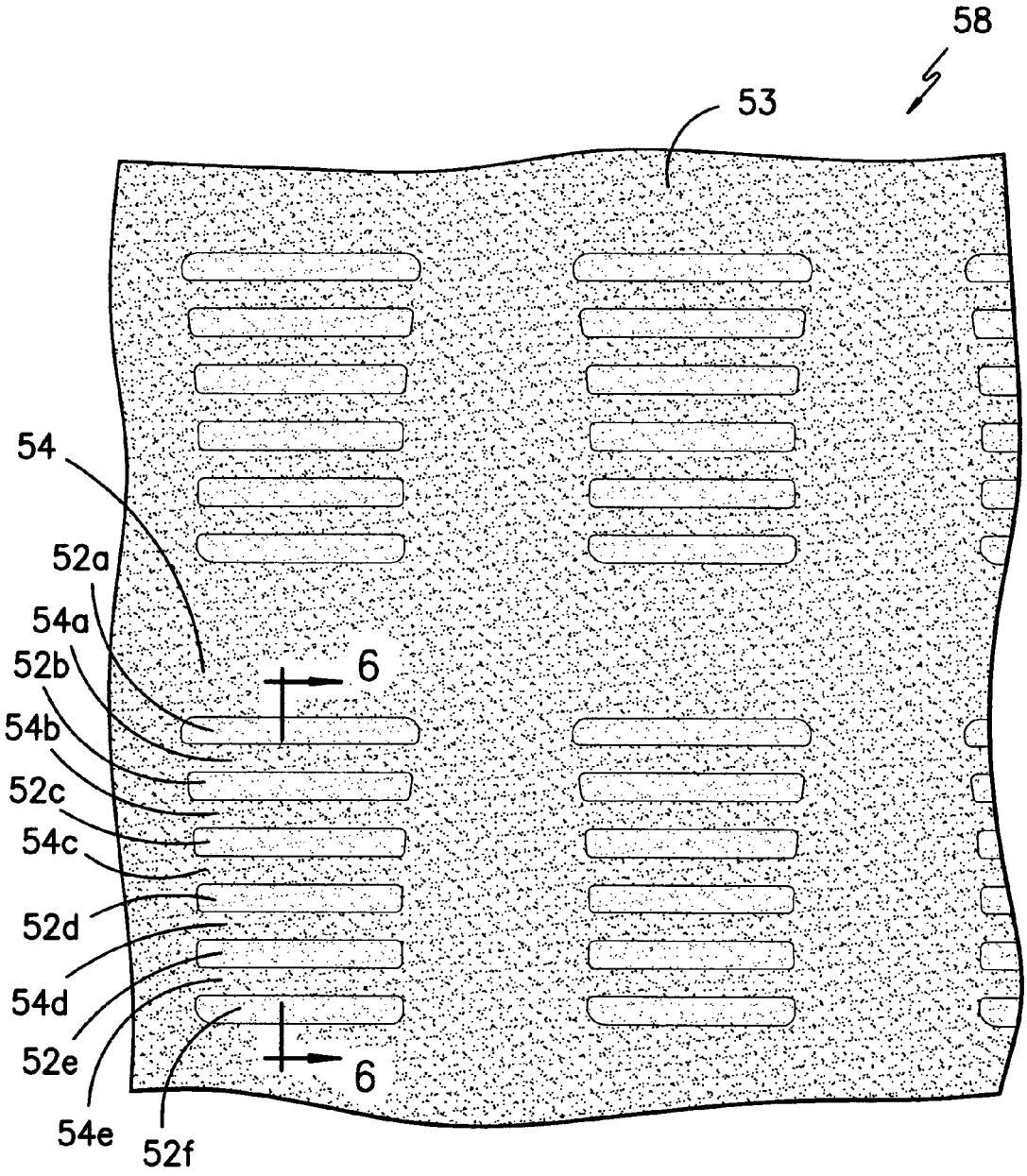
FIG. 5 shows a bolt of manufactured circular knit pile fabric corresponding to the fabric of FIG. 4.
Figure 6:
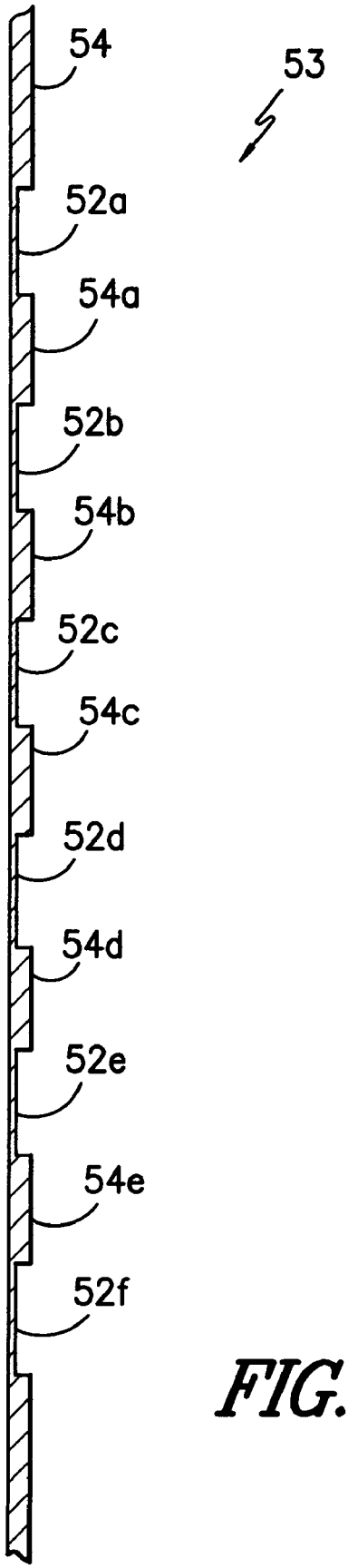
FIG. 6 is a cross-section along line 6-6 of FIG. 5.

FIGS. 4-6 show a second embodiment of the invention in which there is only a non-pile region and a single pile-containing region on the fabric. Chair 50 consists in part of seat back 51 and seat 56, with the back 51 having applied thereon a fabric 53. In this particular embodiment, a different pattern is shown in which alternating regions of no pile and pile are provided with horizontal orientation. Translucent non-pile first regions 52*a-f* are shown. Between the first regions are second regions 54*a-e*, which are pile-containing regions. This particular embodiment shows two different types of regions, one with pile and one without, in an alternating horizontal pattern. But, it is recognized that a designer could employ any design he or she wished to manufacture, and such design could be programmed into the knitting machine to produce a fabric that provides translucent non-pile first regions 52A-f in exactly the configuration that is desired for visual appeal. In this particular embodiment, the lumbar support mechanism 60 is partially visible through translucent non-pile first regions 52*e* and 52*f*, which gives the viewer of the chair the hint or sense that the chair is lumbar supported, without showing the fine details of that support. Some consumers find this desirable and believe that it connotes a high quality chair 50.

FIG. 5 shows a bolt 58 of the fabric 53. Several portions are shown that are cut to form individual portions of fabric for application to seat backs 51. Also, lines 6-6 indicate the cross-sectional view along one fabric portion, which shows fabric 53 having alternating regions of no pile and pile. Translucent non-pile first regions 52*a-f* are shown; and further, between the first regions 52*a-f* are second regions 54*a-e*, which are pile-containing regions.

EXAMPLE 1

A circular knit pile fabric similar to that shown in FIGS. 1-3 is manufactured using a Monarch SEC/PLT 44 SK Knitting machine, manufactured by Fukahara Industrial & Trading Co., Ltd. Osaka, Japan. The fabric is 100% polyester, and is knitted using a textured polyester yarn having one ply yarn, 250 denier with 96 filaments per yarn (1/250/96) as the pile or surface yarn. Further, a multifilament elastomeric ground yarn having one ply, 250 denier and 20 filaments per yarn (1/250/20) The yarn was extruded using Riteflex® polymer from Ticona, Inc. at Fiber Science in Palm Bay Fla. The use of the elastomeric ground yarn gives the finished fabric stretch in essentially all directions. The pile pattern applied will correspond to the particular chair for which the fabric is manufactured, and in this instance is similar to that shown in FIGS. 1-3. The fabric is manufactured in a no loop, low loop, and high loop configuration (which corresponds to the non-pile first region 20, second region 22, and the third regions 24*a*, 24*b*, respectively). After manufacture, the fabric is slit and dyed. Various dyes may be used. Then, the fabric is dried.

Optional Finishing of Fabric

In one particular embodiment of the invention, the fabric may receive an optional treating composition. This treating composition may include a flurochemical that acts as a repellent. Further, the composition may include an optional antimicrobial agent. The composition may comprise a first fluoropolymer, such as a dual action release type fluoropolymer, and/or a second fluoropolymer, such as a repellent type fluoropolymer. This optional treating composition also may or may not include a blocked isocyanate cross-linking agent. A foaming agent is sometimes helpful.

Alphasan™ RC 5000 is an optional antimicrobial compound of silver zirconium phosphate, which may be obtained from Milliken and Company of Spartanburg, S.C. This compound may be applied in an amount of 0.01 weight percent to about 8 weight percent of the treatment composition. The treating composition as described may be foamed upon the previously dyed and dried fabric.

Measurement of the Translucent Feature of Fabric

NIR % Transmittance Analysis. A near infrared transmittance analysis of the fabric in Example 1 (first embodiment shown in FIGS. 1-3) was performed to determine the degree of tranlucency of various regions of the fabric. The greater the transmittance of light, the more translucent the given fabric region, which enables objects to be viewed through the given fabric region.

The human eye is sensitive to light which lies in a very small region of the electromagnetic spectrum labeled "visible light". This "visible light" corresponds to a wavelength range of 400-700 nanometers (nm) and a color range of violet through red. The human eye is not capable of "seeing" radiation with wavelengths outside the visible spectrum. The visible colors from shortest to longest wavelength are: violet, blue, green, yellow, orange, and red. Ultraviolet radiation has a shorter wavelength than the visible violet light. Infrared radiation has a longer wavelength than visible red light. The white light is a mixture of the colors of the visible spectrum. Black is a total absence of light.

Figure 7:
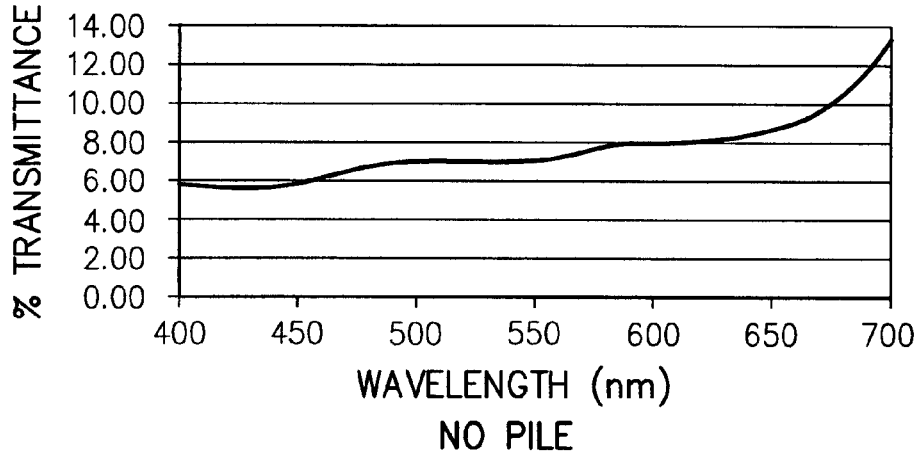
FIGS. 7-9 are graphs showing data of % Transmittance data corresponding to the amount of light that may be transmitted through the various defined regions of the fabric of FIGS. 1-3.
Figure 8:
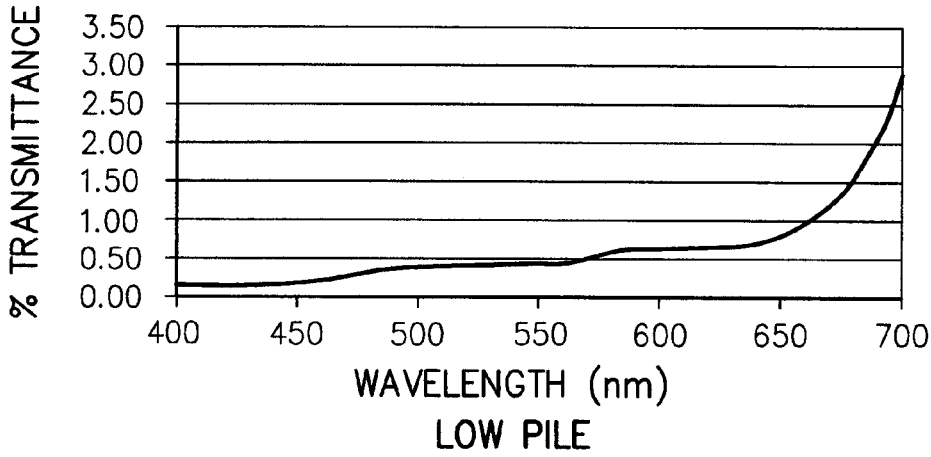
Figure 9:
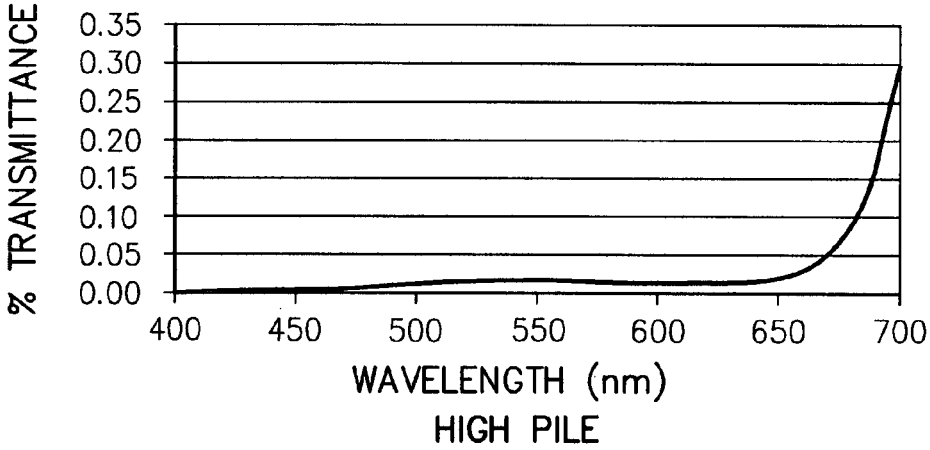

In the testing, the non-pile first region 20, the second region 22 having a pile of a first (low) height, and the third region 24*a* having a pile of a second (higher) height were measured. Results are shown graphically in FIGS. 7-9. FIG. 7 and Table 1 show results for non-pile first region 20. FIG. 8 and Table 2 shows results for second region 22 having a pile of a first (low) height. FIG. 9 and Table 3 show results for third region 24*a* (relatively higher pile).

FIG. 7 shows the translucency of the non-pile first region 20, in which the % Transmittance in the middle of the visible light range @ 550 nm is about 7% Transmittance. By contrast, the low pile second region 22 at the same wavelength of 550 nm shows somewhat less than 0.5% Transmittance. This is substantially less than the results for the translucent non-pile first region 20. Further, the high pile third region 24*a* reveals a % Transmittance at 550 nm of about 0.017, which is negligible and almost completely opaque. For purposes of this invention, a value above about 5% Transmittance is considered "translucent", such that only the non-pile first region 20 is considered translucent.

TABLE 1

| No Pile Region | |
|---|---|
| Wavelength [nm] | Average % Transmittance |
| 700 | 13.1717 |
| 690 | 11.6763 |
| 680 | 10.5030 |
| 670 | 9.6923 |
| 660 | 9.0373 |
| 650 | 8.5910 |
| 640 | 8.2953 |
| 630 | 8.1310 |
| 620 | 8.0583 |
| 610 | 8.0230 |
| 600 | 8.0070 |
| 590 | 7.9760 |
| 580 | 7.8213 |
| 570 | 7.4857 |
| 560 | 7.2027 |
| 550 | 7.1490 |
| 540 | 7.2113 |
| 530 | 7.1497 |
| 520 | 7.0337 |
| 510 | 7.0433 |
| 500 | 7.0647 |
| 490 | 6.9150 |
| 480 | 6.6940 |
| 470 | 6.4330 |
| 460 | 6.1453 |
| 450 | 5.8983 |
| 440 | 5.7380 |
| 430 | 5.6467 |
| 420 | 5.6100 |
| 410 | 5.6120 |
| 400 | 5.6657 |

TABLE 2

| Low Pile Region | |
|---|---|
| Wavelength [nm] | Average % Transmittance |
| 700 | 2.8583 |
| 690 | 2.1013 |
| 680 | 1.5603 |
| 670 | 1.2060 |
| 660 | 0.9633 |
| 650 | 0.8110 |
| 640 | 0.7193 |
| 630 | 0.6673 |
| 620 | 0.6450 |
| 610 | 0.6320 |
| 600 | 0.6237 |
| 590 | 0.6160 |
| 580 | 0.5777 |
| 570 | 0.5033 |
| 560 | 0.4447 |
| 550 | 0.4373 |
| 540 | 0.4480 |
| 530 | 0.4320 |
| 520 | 0.4077 |
| 510 | 0.4093 |
| 500 | 0.4090 |
| 490 | 0.3767 |
| 480 | 0.3293 |
| 470 | 0.2797 |
| 460 | 0.2287 |
| 450 | 0.1903 |
| 440 | 0.1660 |
| 430 | 0.1533 |
| 420 | 0.1487 |
| 410 | 0.1477 |
| 400 | 0.1503 |

TABLE 2-continued

| Low Pile Region | |
|---|---|
| Wavelength [nm] | Average % Transmittance |

TABLE 3

| High Pile Region | |
|---|---|
| Wavelength [nm] | Average % Transmittance |
| 700 | 0.3050 |
| 690 | 0.1640 |
| 680 | 0.0897 |
| 670 | 0.0547 |
| 660 | 0.0347 |
| 650 | 0.0257 |
| 640 | 0.0200 |
| 630 | 0.0173 |
| 620 | 0.0167 |
| 610 | 0.0157 |
| 600 | 0.0147 |
| 590 | 0.0153 |
| 580 | 0.0157 |
| 570 | 0.0163 |
| 560 | 0.0167 |
| 550 | 0.0170 |
| 540 | 0.0167 |
| 530 | 0.0167 |
| 520 | 0.0167 |
| 510 | 0.0153 |
| 500 | 0.0140 |
| 490 | 0.0123 |
| 480 | 0.0093 |
| 470 | 0.0073 |
| 460 | 0.0050 |
| 450 | 0.0027 |
| 440 | 0.0030 |
| 430 | 0.0043 |
| 420 | 0.0043 |
| 410 | 0.0050 |
| 400 | 0.0053 |

The procedure for the measurement of % Transmittance is set forth herein. The machine used for this testing was a Jasco V-570 UV/VIS/NIR spectrophotometer V-570. First, the instrument was initialized. Then, the following steps were performed, in this order:

1. Click on Spectra Manager (w/instant picture)

2. Click 2×'s on Spectrum Measurement. (The instrument will initialize.)

3. Maximize Spectrum Measurement

4. Click measurement

5. Click on Parameters
   Open
   SPF/UPF (UPF MTCC Test 183-2000)
   200 scan speed
   700 start
   400 end 6. Cut approximately ½ inch square of fabric from the given region.

7. Place 1 layer of fabric over back window, use tape to secure; Close.

8. Click Start.

9. When it has finished click Spectra Analysis.

10. Click Process
Common Options
Data Dump
Thin out to 4 (10 nm)
Copy (Data Dump)

11. Copy results to Lotus notes.
Save data file

12. Turn fabric 90 degrees and repeat steps 7-11

13. Turn fabric 90 degrees and repeat steps 7-11

14. Save file with results

15. Copy to disk and transfer results to LIMS

Embodiments of the subject matter of this application are described in this application, including the best mode known to the inventors for carrying out the claimed subject matter. Variations of those embodiments may become apparent to those of ordinary skill in the art upon reading the description. Although a chair is a featured embodiment and application for the fabric of this invention, it is recognized that the fabric could be used in a similar manner on sofas, couches, love seats, transportation seating, subways, airplanes, trains, rail cars, automobiles, dining chairs, conference chairs, residential chairs, and in commercial office or home furniture of other types, without limitation. The inventors expect skilled artisans to employ such variations as appropriate, and the inventors intend for the subject matter described herein to be practiced otherwise than as specifically described in this text. Accordingly, this disclosure includes all modifications and equivalents of the subject matter recited in the claims. Moreover, any combination of the above-described elements in all possible variations thereof is encompassed by the present disclosure unless otherwise indicated.

The invention claimed is:

1. A patterned circular knit pile support fabric adapted for support applications in seating, the fabric consisting essentially of:

(a) elastomeric multifilament ground yarns; and (b) pile yarns;

(c) wherein the fabric is a support fabric, the fabric being defined in a two-dimensional plane, the plane having a first side and an opposite second side, the fabric being capable of stretch in essentially all directions along the plane; and (d) wherein the fabric is comprised of a plurality of defined knitted regions arranged in a pattern on the fabric, the fabric having at least a non-pile translucent first region and a second region having a pile of a first height.

2. The fabric of claim 1, the fabric further comprising:

(e) a third region having a pile of a second height, wherein the second height is greater than the first height.

3. The fabric of claim 1, wherein whereby an object positioned on a first side of the fabric is visible from the second side of the fabric when the object is viewed through the non-pile translucent first region of the fabric, the non-pile translucent first region of the fabric having a light transmittance value of at least about 5% Transmittance in the light range of 400-700 nm.

4. The fabric of claim 1 wherein the pile yarns are comprised of textured polyester.

5. The fabric of claim 1 wherein the fabric consists essentially of polyester.

6. The fabric of claim 1 wherein the fabric further comprises a fluorochemical-containing repellent finish upon the pile of the fabric.

7. The fabric of claim 1 further comprising an antimicrobial agent.

8. The fabric of claim 6 wherein the finish comprises at least one fluoropolymer.

9. The fabric of claim 3 wherein the non-pile translucent first region of the fabric comprises a % Transmittance of between about 5 and about 13.

10. The fabric of claim 9 wherein the non-pile translucent first region of the fabric comprises a % Transmittance of at least about 7 at a wavelength of 550 nm.

11. A method of making a support fabric, the method comprising:

(a) providing an elastomeric yarn as a ground yarn, (b) providing a polyester yarn as a pile yarn, (c) circular knitting the elastomeric yarn and polyester yarn together to form a knitted support fabric being defined in a two-dimensional plane, the plane having a first side and an opposite second side, the fabric being capable of stretch in essentially all directions along the plane, (d) slitting the support fabric, (e) the support fabric being comprised of a plurality of knitted regions arranged in a pre-defined pattern on the support fabric, said support fabric having at least a non-pile translucent first region and a second region having a pile of a first height, (f) the support fabric being translucent through at least the first region of the fabric, whereby an object positioned on a first side of the support fabric is visible from the second side of the support fabric when the object is viewed through the non-pile translucent first region of the fabric.

12. The method of claim 11, wherein the support fabric additionally comprises a third region having a pile of a second height, wherein said second height is greater than the first height.

13. The method of claim 11, wherein whereby an object positioned on a first side of the support fabric is visible from the second side of the fabric when the object is viewed through the non-pile translucent first region of the fabric, the non-pile translucent region of the fabric having a light transmittance value of at least about 5% Transmittance within the light wavelength range of 400-700 nm.

14. The method of claim 11 wherein the non-pile translucent first region of the fabric comprises a % Transmittance in the range of about 5 to about 13.

15. The method of claim 14 wherein the non-pile translucent first region of the fabric comprises a % Transmittance of at least about 7 at 550 nm.

16. The method of claim 11 comprising the additional step of:

(g) heat setting the fabric.

17. The method of claim 16 comprising the additional step of:

(h) dying the fabric.

18. The method of claim 17 comprising the additional step of:

(i) applying a fluorochemical-containing finish to the fabric.

19. The method of claim 18 wherein the finish comprises at least one fluoropolymer.

20. The method of claim 19 wherein the finish additionally comprises an antimicrobial agent.

* * * * *